US009471084B2

(12) United States Patent
Kobayashi

(10) Patent No.: US 9,471,084 B2
(45) Date of Patent: Oct. 18, 2016

(54) APPARATUS AND METHOD FOR A MODIFIED BROKAW BANDGAP REFERENCE CIRCUIT FOR IMPROVED LOW VOLTAGE POWER SUPPLY

(71) Applicant: Dialog Semiconductor GmbH, Kirchheim/Teck-Nabern (DE)

(72) Inventor: Hidenori Kobayashi, Kawasaki (JP)

(73) Assignee: Dialog Semiconductor (UK) Limited, Reading (GB)

( * ) Notice: Subject to any disclaimer, the term of this patent is extended or adjusted under 35 U.S.C. 154(b) by 53 days.

(21) Appl. No.: 14/181,749

(22) Filed: Feb. 17, 2014

(65) Prior Publication Data

US 2015/0227156 A1 Aug. 13, 2015

(30) Foreign Application Priority Data

Feb. 11, 2014 (EP) ..... 14368016

(51) Int. Cl.

| | |
|---|---|
| ***G05F 3/16*** | (2006.01) |
| ***G05F 3/22*** | (2006.01) |
| ***G05F 1/10*** | (2006.01) |
| ***G05F 3/30*** | (2006.01) |

(52) U.S. Cl.

CPC . *G05F 3/16* (2013.01); *G05F 1/10* (2013.01); *G05F 3/22* (2013.01); *G05F 3/30* (2013.01)

(58) Field of Classification Search

CPC ..... G05F 3/16
USPC ..... 323/268, 313, 315
See application file for complete search history.

(56) References Cited

U.S. PATENT DOCUMENTS

| | | | | |
|---|---|---|---|---|
| 4,789,819 | A | 12/1988 | Nelson | |
| 5,982,201 | A | 11/1999 | Brokaw et al. | |
| 6,407,622 | B1 | 6/2002 | Opris | |
| 6,946,825 | B2 | 9/2005 | Tesi | |
| 7,199,646 | B1 | 4/2007 | Zupcau et al. | |
| 7,208,930 | B1 | 4/2007 | Tran et al. | |
| 7,400,187 | B1 | 7/2008 | Chen | |
| 2004/0124822 | A1 | 7/2004 | Marinca | |
| 2007/0257729 | A1 * | 11/2007 | Pigott et al. | 327/539 |
| 2008/0088361 | A1 | 4/2008 | Kimura | |
| 2008/0224759 | A1 * | 9/2008 | Marinca | 327/539 |
| 2010/0123514 | A1 | 5/2010 | Le et al. | |

OTHER PUBLICATIONS

European Search Report, 14368016.3-1807, Mailed: Jul. 31, 2014.

* cited by examiner

*Primary Examiner* — Jeffrey Gblende
*Assistant Examiner* — Trinh Dang
(74) *Attorney, Agent, or Firm* — Saile Ackerman LLC; Stephen B. Ackerman

(57) ABSTRACT

An apparatus and method for a bandgap voltage reference circuit with improved operation for a low voltage power supply. A bandgap voltage reference circuit which is operable at low power supply voltage for power supplies of 1.3V comprising of a first npn bipolar transistor, a second npn bipolar transistor, a third npn bipolar transistor, a first resistor, a second resistor, a third resistor, a fourth resistor, and a first, second and third p-channel MOSFET. The matched second resistor and third resistor, and the first and third npn bipolar transistor pair establishes a ΔVbe dependent current (a PTAT current), and the fourth resistor established a ΔVbe to establish a bandgap voltage of approximately 1.2V.

23 Claims, 3 Drawing Sheets

APPARATUS AND METHOD FOR A MODIFIED BROKAW BANDGAP REFERENCE CIRCUIT FOR IMPROVED LOW VOLTAGE POWER SUPPLY

BACKGROUND

1. Field

The disclosure relates generally to a bandgap reference circuit and, more particularly, to a bandgap reference circuit device for a low voltage power supply thereof.

2. Description of the Related Art

Bandgap reference circuits are a type of voltage reference circuit used in conjunction with semiconductor devices, integrated circuits (IC), and other applications. The requirement for a stable reference voltage is universal in electronic design. Using a two transistor circuit, collector current sensing can provide minimization of errors due to the base current. In a bandgap voltage reference circuit, the voltage difference between two p-n junctions (e.g. diodes, or bipolar transistors), operated at different current densities, can be used to generate a proportional to absolute temperature (PTAT) current in a first resistor. This current can then be used to generate a voltage in a second resistor. This voltage, in turn, is added to the voltage of one of the junctions. The voltage across a diode operated at a constant current, or herewith a PTAT current, is complementary to absolute temperature (CTAT). If the ratio between the first and second resistor is chosen properly, the first order effects of the temperature dependency of the diode and the PTAT current will cancel out. In this fashion, a circuit can be independent of temperature variation, and provide a constant voltage reference.

Circuits of this nature that are temperature insensitive are referred to as bandgap voltage reference circuits. The resulting voltage is about 1.2-1.3V, depending on the particular technology and circuit design, and is close to the theoretical silicon bandgap voltage of 1.22 eV at 0 degrees Kelvin. The remaining voltage change over the operating temperature of typical integrated circuits is on the order of a few millivolts. Because the output voltage is by definition fixed around 1.25V for typical bandgap reference circuits, the minimum operating voltage is about 1.4V.

A circuit implementation that has this characteristic is called a Brokaw bandgap reference circuit. The Brokaw bandgap reference circuit is a voltage reference circuit that is widely used in integrated circuit technology to establish a voltage reference. The Brokaw bandgap reference circuit has an output voltage of approximately 1.25V, and has very little temperature dependence. Like all temperature-independent bandgap references, the circuit maintains an internal voltage source that has a positive temperature coefficient (PTC) and another internal voltage source that has a negative temperature coefficient (NTC). By summing the two together, the temperature dependence can be canceled. Additionally, either of the two internal sources can be used as a temperature sensor. In the Brokaw bandgap reference, the circuit uses negative feedback to force a constant current through two bipolar transistors with different emitter areas. The transistor with the larger emitter area requires a smaller base-emitter voltage, $V_{BE}$, (e.g. or Vbe) for the same current. The base-emitter voltage for each transistor has a negative temperature coefficient (i.e., it decreases with temperature). The difference between the two base-emitter voltages has a positive temperature coefficient (i.e., it increases with temperature). With proper component choices, the two opposing temperature coefficients will cancel each other exactly and the output will have no temperature dependence.

FIG. 1 shows the circuit schematic for the Brokaw bandgap circuit. The circuit is powered using a VDD power supply 10, and ground power supply 20. The output of the circuit is VREF 30. The circuit contains a first npn bipolar transistor, NPN1 70, and a second npn bipolar transistor, NPN2, 80. The circuit network contains a first resistor R1 90, and a second resistor R2 95 to provide a feedback network. A first p-channel MOSFET, PMOS1, 40 and second p-channel MOSFET, PMOS2 50, serve as current sources for the NPN1 70 and NPN2 80 transistors, respectively. For the output voltage reference, a third p-channel MOSFET, PMOS3 60 and resistor R3 100 are provided. The base-emitter voltage of NPN 1 70 is referred to as Vbe1. The base-emitter voltage of NPN2 80 is referred to as Vbe2. The voltage drop across first resistor R1 90 is kT/q ln {J1/J2} where J1 and J2 is the current density flowing through NPN1 70, and NPN2 80, respectively. The voltage drop across second resistor R2 95 is equal to 2 (R2/R1) {kT/q} ln {J1/J2}.

The first and second npn bipolar transistors, NPN1 70 and NPN2 80, are of different physical size. When the voltage at their common base is small, the voltage drop, the voltage drop across the resistor R1 90 is small, the larger area of NPN2 causes it conduct more of the total current available through R2 95. The resulting imbalance in collector voltages drives the op amp so as to raise the base voltage. Alternatively, if the base voltage is high, a large current is forced through R2 95 leading to a voltage drop across R1 90 will limit the current flow through NPN2 80. Between the two extreme imbalance of the collectors, is a base voltage at which the collector currents match. The npn layout of NPN1 70 and NPN2 80 can have different "emitter finger" numbers to establish different physical bipolar transistor sizes. This can be designated by 1:M, indicating the ratio of emitter fingers of 1 in NPN1 70 and multiplicity of M in NPN2 80. The two transistors establish a differential voltage in the base-emitter voltage, referred to as a so-called "delta Vbe voltage" (Δ Vbe), $$\Delta Vbe=\{kT/q\}\ \ln\ [J1/J2].$$

Hence, the differential voltage, ΔVbe, is proportional to the current flowing through the NPN1 70 and NPN2 80. The collector current flowing through collector of NPN1 70 is equal to the current flowing through PMOS1 40. The collector current flowing through NPN2 80 is equal to the current flowing through PMOS2 50. Therefore, PMOS1 40 and PMOS2 50 current ratio is proportional to "delta" Vbe voltage, which is proportional to absolute temperature (PTAT). Assuming the resistor ratio and current density ratio are invariant, the voltage varies directly with absolute temperature T.

In this network, the base of NPN1 70 and NPN2 80 are electrically connected, providing a common base voltage condition. The base voltage of NPN1 70 and NPN2 80 base (which are connected) can be calculated according to the following $$R2\cdot\frac{\Delta Vbe}{R1}+Vbe$$

The Delta Vbe, Δ Vbe (also denoted as D Vbe), and Vbe can cancel out the temperature coefficient, because Δ Vbe has a positive temperature coefficient (PTC) and Vbe has a negative temperature coefficient (NTC) and creates the temperature independent, so-called bandgap voltage. The utilization of the transistor base-emitter diode temperature compensated to the bandgap voltage of silicon is a technique to establish the bandgap voltage. This is usually becomes approximately ~1.2V.

However, in this Brokaw bandgap circuit, the common base voltage, $V_B$, of NPN1 70 and NPN2 80 is approximately ~1.2V. Therefore, the collector voltage of NPN1 70 should be higher than the value of ~1.2V. The p-channel MOSFET, PMOS1 source and gate voltage needs to be more than a threshold voltage of a PMOS transistor, which usually more than 0.4V~0.7V; in addition, some additional voltage is desirable to provide good matching PMOS1 40 and PMOS2 50. Therefore, in this case, the supply voltage must be more than 1.6V. Additionally, a supply voltage of more than 2V is desirable in this circuit. It is difficult to make this circuit operable in ideally, a 1.5V power supply voltage range.

With technology scaling, according to constant electric field scaling theory, the power supply voltage, $V_{DD}$, continues to decrease to maintain dielectric reliability. In current and future semiconductor process technology, having minimum dimensions of for example, 0.18 μm, and 0.13 μm, the native power supply voltage (or internal power supply voltage) is 1.5V internal supply voltage for digital circuits, and other sensitive analog circuitry. In the range of 1.5 V power supply voltage, the Brokaw bandgap reference does not provide desirable operability, or ideal operating characteristics. For technologies whose minimum dimension is below 0.13 μm, the issue is also a concern.

In bandgap voltage references, usage of Brokaw style bandgap regulators have been discussed. As discussed in U.S. Pat. No. 7,208,930 to Tran et al, a Brokaw style bandgap voltage regulator is described comprising a that comprise of bipolar current mirror, resistor divider networks and a bipolar output device.

In bandgap voltage references, bandgap circuits on the order of 1V have been discussed. As discussed in U.S. Pat. No. 7,199,646 to Zupcau et al., a bandgap circuit topology allows for function at low power supply voltages, on the order of 1V. The circuit has a replication circuit, and an output stage containing a current mirror.

In bandgap voltage references, bipolar assembly and mirror assembly have been shown. As discussed in published U.S. Pat. No. 6,946,825 to Tesi et al. shows a circuit with a current mirror assembly of cascode type.

In bandgap voltage references, alternative embodiments have been discussed. As discussed in U.S. Pat. No. 5,982,201 to Brokaw et al, a bipolar current mirror network, a resistor divider network, and an output transistor allow for operation with supply voltages of less than two junction voltage drops.

In these prior art embodiments, the solution to improve the operability of a low voltage bandgap circuit utilized various alternative solutions.

It is desirable to provide a solution to address the disadvantages of the low voltage operation of a bandgap reference circuit.

SUMMARY

A principal object of the present disclosure is to provide a circuit which allows for operation of a modified Brokaw bandgap circuit for low power supply voltages.

A principal object of the present disclosure is to provide a bandgap circuit which allows operation for power supply voltages below 2V.

A principal object of the present disclosure is to provide a bandgap circuit that sets the NPN base voltage lower than the bandgap voltage (~1.2V).

Another further object of the present disclosure is to provide a bandgap circuit and add the voltage to create the bandgap voltage in another branch.

As such, a bandgap reference circuit device with an improved operation for low power supply voltages is disclosed.

In summary, a bandgap voltage reference circuit between a power supply node and a ground node and configured for generating a reference voltage, comprising of a bandgap voltage network providing a base emitter voltage, a feedback network providing feedback function to a bandgap voltage network, a current mirror sourcing said bandgap voltage network, and an output network function providing a lower stabilized output voltage.

In addition, a band gap voltage reference circuit with improved operation at low voltage power supply is disclosed, the circuit comprising a first npn bipolar transistor, a second npn bipolar transistor wherein the base of the second npn bipolar transistor and first npn bipolar transistor are electrically coupled providing a differential voltage in the base-emitter voltage, a third npn bipolar transistor wherein the base of the third npn bipolar transistor is electrically connected to the base of said first npn bipolar transistor and electrically connected to the collector of the third npn bipolar transistor, a first resistor element electrically connected to the emitter of the second npn bipolar transistor, a second resistor element electrically connected to the emitter of the first npn bipolar transistor, a third resistor element electrically connected to the emitter of the third npn bipolar transistor, a fourth resistor element electrically connected to the collector of the third npn bipolar transistor, a first p-channel MOSFET wherein the p-channel MOSFET gate and drain are electrically connected to the first npn bipolar transistor, a second p-channel MOSFET wherein the p-channel MOSFET gate is electrically connected to the first p-channel MOSFET and whose p-channel MOSFET drain is electrically connected to the second npn bipolar transistor, a third p-channel MOSFET wherein the p-channel MOSFET gate is electrically connected to the p-channel MOSFET and whose p-channel MOSFET drain is electrically connected to the fourth resistor; and, a bandgap voltage reference output wherein the bandgap voltage reference output is connected to the third p-channel MOSFET drain, and the fourth resistor. In addition, it is clear that the p-channel MOSFETs can be replaced by pnp bipolar transistors.

In addition, a bandgap voltage reference circuit with improved operation at low voltage power supply, the circuit comprising a first npn bipolar transistor, a second npn bipolar transistor wherein the base of the second npn bipolar transistor and first npn bipolar transistor are electrically coupled, a third npn bipolar transistor wherein the base of the third npn bipolar transistor is electrically connected to the base of the first npn bipolar transistor and electrically connected to the collector of the third npn bipolar transistor, a first resistor element electrically connected to the emitter of the second npn bipolar transistor, a second resistor element electrically connected to the emitter of the first npn bipolar transistor, a third resistor element electrically connected to the emitter of said third npn bipolar transistor, a fourth resistor element electrically connected to the collector of the third npn bipolar transistor, a first pnp bipolar transistor wherein the first pnp bipolar transistor base and collector are electrically connected to the first npn bipolar transistor, a second pnp bipolar transistor wherein the second pnp bipolar transistor base is electrically connected to the first pnp bipolar transistor and electrically connected to the second npn bipolar transistor, a third pnp bipolar transistor wherein the third pnp bipolar transistor base is electrically connected to the second pnp bipolar transistor and electrically connected to said fourth resistor, and a bandgap voltage reference output wherein the bandgap voltage reference output is connected to the third pnp bipolar transistor, and the fourth resistor.

In addition, a method of a bandgap voltage reference circuit is comprising the following steps: a first step providing a first npn bipolar transistor, a second npn bipolar transistor, a third npn bipolar transistor, a first resistor, a second resistor, a third resistor, a fourth resistor, and a first, second and third p-channel MOSFET; a second step forming a emitter ratio of 1:M for the first and said second npn bipolar transistors; a third step matching the second resistor and the third resistor; a fourth step establishing a Δ Vbe dependent current from the first and third npn bipolar transistor; a fifth step establishing a Δ Vbe with the fourth resistor; and lastly, a sixth step calculating a bandgap output voltage as a function of Vbe, ΔVbe, and the first resistor, said third resistor, and the fourth resistor.

Other advantages will be recognized by those of ordinary skill in the art.

BRIEF DESCRIPTION OF THE DRAWINGS

The present disclosure and the corresponding advantages and features provided thereby will be best understood and appreciated upon review of the following detailed description of the disclosure, taken in conjunction with the following drawings, where like numerals represent like elements, in which.

DETAILED DESCRIPTION

Figure 1:
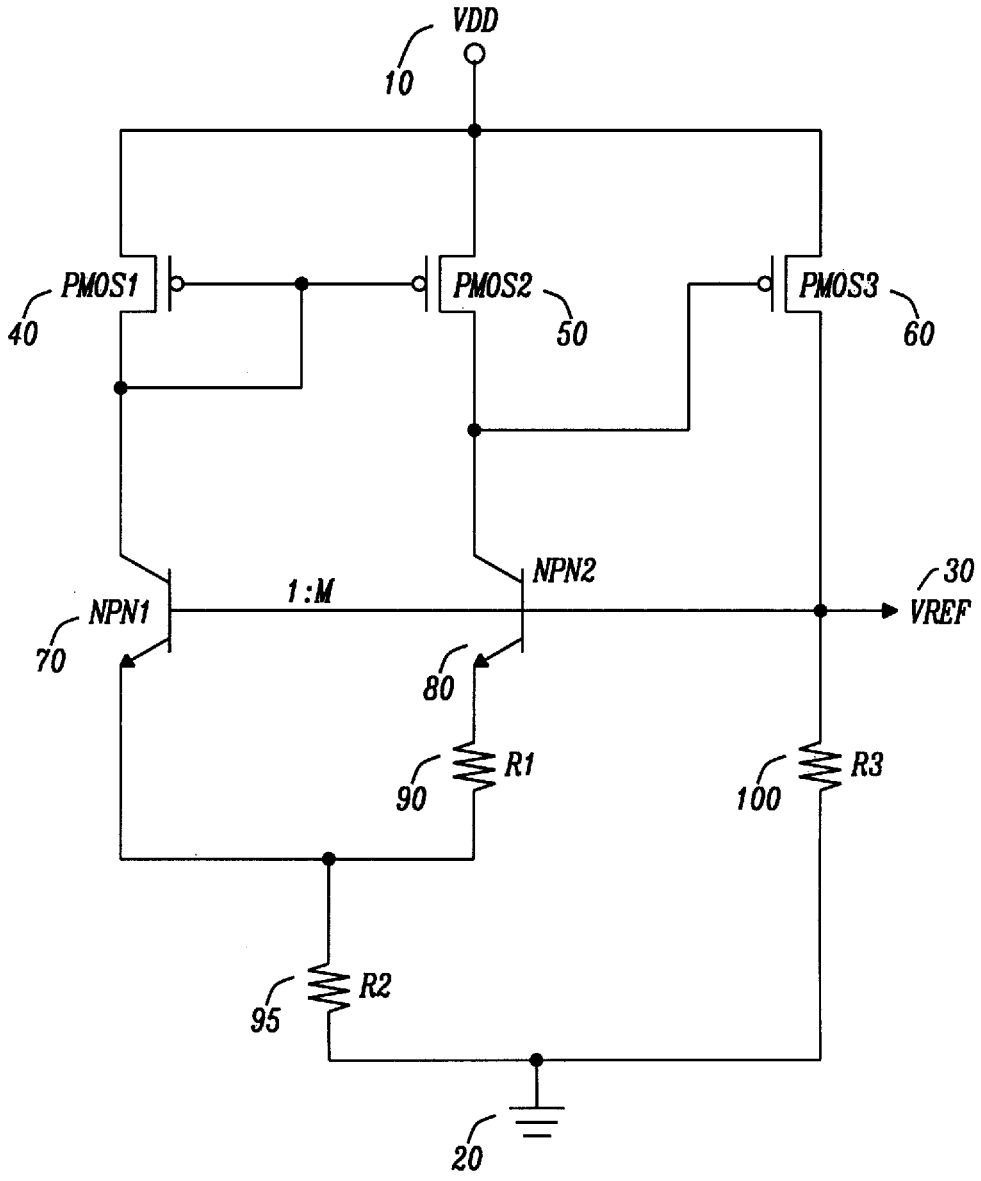
FIG. 1 Prior Art
FIG. 1 is a prior art example of a Brokaw bandgap circuit.

FIG. 1 is a prior art example of a Brokaw bandgap circuit in accordance with a prior art embodiment. The circuit is powered using a VDD power supply 10, and ground power supply 20. The output of the circuit is VREF 30. The circuit contains a first npn bipolar transistor, NPN1 70, and a second npn bipolar transistor, NPN2, 80. The circuit network contains a first resistor R1 90, and a second resistor R2 95 to provide a feedback network. A first p-channel MOSFET, PMOS1, 40 and second p-channel MOSFET, PMOS2 50, serve as current sources for the NPN1 70 and NPN2 80 transistors, respectively. For the output voltage reference, a third p-channel MOSFET, PMOS3 60 and resistor R3 100 are provided. The base-emitter voltage of NPN 1 70 is referred to as Vbe1. The base-emitter voltage of NPN2 80 is referred to as Vbe2. The voltage drop across first resistor R1 90 is kT/q ln {J1/J2} where J1 and J2 is the current density flowing through NPN1 70, and NPN2 80, respectively. The voltage drop across second resistor R2 95 is equal to 2 (R2/R1) {kT/q} ln {J1/J2}.

The first and second npn bipolar transistors, NPN1 70 and NPN2 80, are of different physical size. When the voltage at their common base is small, the voltage drop, the voltage drop across the resistor R1 90 is small, the larger area of NPN2 causes it conduct more of the total current available through R2 95. The resulting imbalance in collector voltages drives the op amp so as to raise the base voltage. Alternatively, if the base voltage is high, a large current is forced through R2 95 leading to a voltage drop across R1 90 will limit the current flow through NPN2 80. Between the two extreme imbalance of the collectors, is a base voltage at which the collector currents match. The npn layout of NPN1 70 and NPN2 80 can have different "emitter finger" numbers to establish different physical bipolar transistor sizes. This can be designated by 1:M, indicating the ratio of emitter fingers of 1 in NPN1 70 and multiplicity of M in NPN2 80. The two transistors establish a differential voltage in the base-emitter voltage, referred to as a so-called "delta Vbe voltage" (Δ Vbe), $$\Delta Vbe=\{kT/q\}\ \ln\ [J1/J2]$$

Hence, the differential voltage, ΔVbe, is proportional to the current flowing through the NPN1 70 and NPN2 80. The collector current flowing through collector of NPN1 70 is equal to the current flowing through PMOS1 40. The collector current flowing through NPN2 80 is equal to the current flowing through PMOS2 50. Therefore, PMOS1 40 and PMOS2 50 current ratio is proportional to "delta" Vbe voltage, which is proportional to absolute temperature (PTAT). Assuming the resistor ratio and current density ratio are invariant, the voltage varies directly with absolute temperature T.

In this network, the base of NPN1 70 and NPN2 80 are electrically connected, providing a common base voltage condition. The base voltage of NPN1 70 and NPN2 80 base (which are connected) can be calculated according to the following $$R2\cdot\frac{\Delta Vbe}{R1}+Vbe.$$

The Delta Vbe, Δ Vbe (also denoted as D Vbe), and Vbe can cancel out the temperature coefficient, because Δ Vbe has a positive temperature coefficient (PTC) and Vbe has a negative temperature coefficient (NTC) and creates the temperature independent, so-called bandgap voltage. The utilization of the transistor base-emitter diode temperature compensated to the bandgap voltage of silicon is a technique to establish the bandgap voltage. This is usually becomes approximately ~1.2V.

However, in this Brokaw bandgap circuit, the common base voltage, $V_B$, of NPN1 70 and NPN2 80 is approximately ~1.2V. Therefore, the collector voltage of NPN1 70 should be higher than the value of ~1.2V. The p-channel MOSFET, PMOS1 source and gate voltage needs to be more than a threshold voltage of a PMOS transistor, which usually more than 0.4V~0.7V; in addition, some additional voltage is desirable to provide good matching of PMOS1 40 and PMOS2 50. Therefore, in this case, the supply voltage must be more than 1.6V. Additionally, a supply voltage of more than 2V is desirable in this circuit. It is difficult to make this circuit operable in ideally, a 1.5V power supply voltage range.

Figure 2:
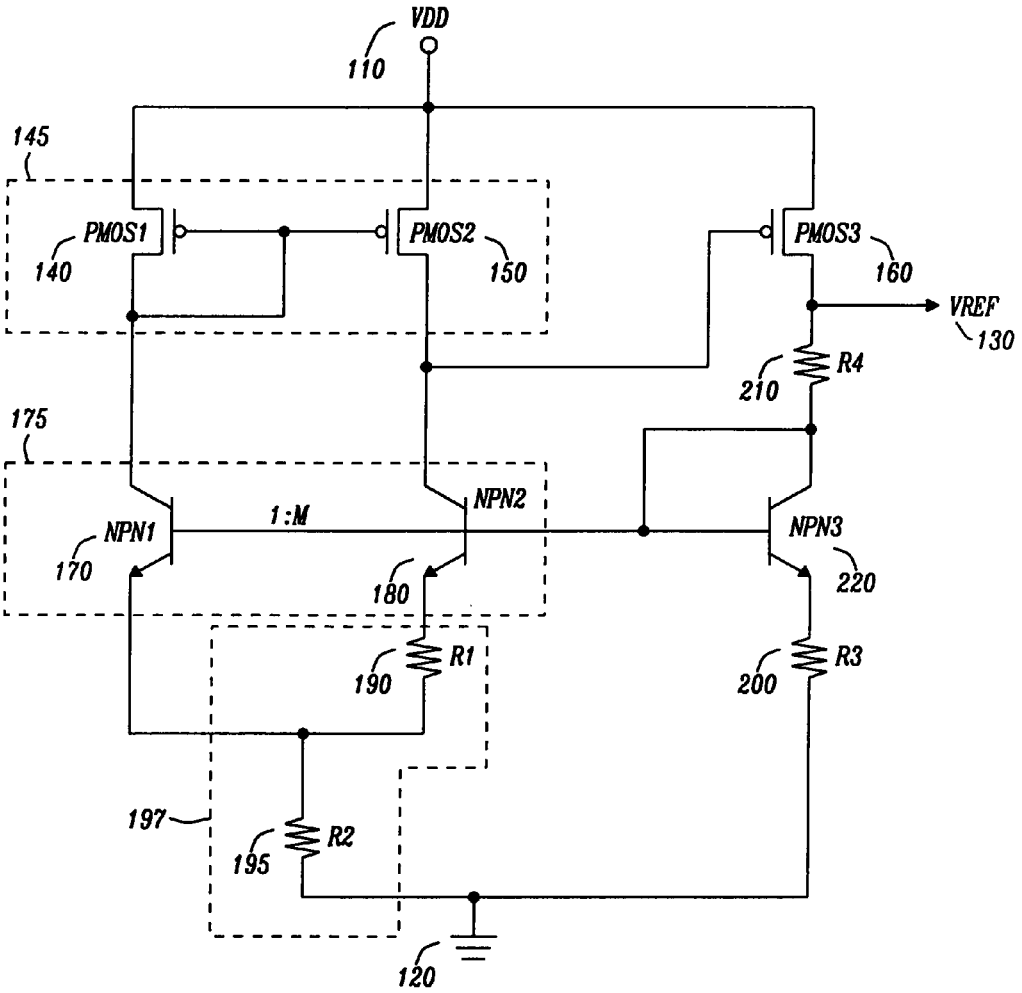
FIG. 2 is a circuit schematic of a modified Brokaw bandgap circuit in accordance with an embodiment of the disclosure; and, FIG. 3 is a method for providing a modified Brokaw bandgap circuit in accordance with an embodiment of the disclosure.

FIG. 2 is a circuit schematic of an modified Brokaw bandgap circuit in accordance with an embodiment of the disclosure. A modified Brokaw bandgap voltage reference circuit is between a power supply node and a ground node and configured for generating a reference voltage, comprising of a bandgap voltage network providing a base emitter voltage, a feedback network providing feedback function to a bandgap voltage network, a current mirror sourcing said bandgap voltage network, and an output network function providing a lower stabilized output voltage. The circuit is powered using a VDD power supply 110, and ground power supply 120. The output of the circuit is VREF 130. The circuit contains a first npn bipolar transistor, NPN1 170, and a second npn bipolar transistor, NPN2, 180. This network 175 forms a bandgap voltage network providing a base emitter voltage. The circuit network contains a first resistor R1 190, and a second resistor R2 195 to provide a feedback network providing feedback function to a bandgap voltage network, A first p-channel MOSFET, PMOS1, 140 and second p-channel MOSFET, PMOS2 150, form a current mirror 145, and serves as current sources for the NPN170 and NPN2 180 transistors, respectively. For the output voltage reference, a third p-channel MOSFET, PMOS3 160 and resistor R3 200 are provided. The output network function provides a lower stabilized output voltage. For this embodiment, an additional npn bipolar transistor NPN3 220 is configured in a current mirror configuration with the parallel combination of NPN1 170 and NPN2 180, electrically coupling the npn base regions of NPN1 170, NPN2 180 and NPN3 220. The NPN3 220 has its base and collector electrically connected to establish the current mirror response. A resistor element R4 210 is electrically connected between NPN3 220 and PMOS 3 160.

The first and second npn bipolar transistors, NPN1 170 and NPN2 180, are of different physical size. The npn layouts of NPN1 170 and NPN2 180 can be of different "emitter finger" numbers to establish different physical bipolar transistor sizes. This can be designated by 1:M, indicating the ratio of emitter fingers of 1 in NPN1 170 and a multiplicity of M fingers in NPN2 180. The two transistors establish a differential voltage in the base-emitter voltage, referred to as so-called "delta Vbe voltage" (Δ Vbe). This establishes a ΔVbe between resistor R1 190 by the feedback. Therefore, PMOS1 140 and PMOS2 150 current is proportional to "delta" Vbe voltage, which is proportional to absolute temperature (PTAT).

In this network, the base of NPN1 170, the base of NPN2 80, and the base of NPN3 are electrically connected, providing a common base voltage condition. The base voltage of NPN1 170, NPN2 180 and NPN3 220 base (which are connected) can be calculated according to the following $$R2 \cdot \frac{\Delta Vbe}{R1} + Vbe$$

and the bandgap output voltage also can be calculated as $$(R3 + R4) \cdot \frac{\Delta Vbe}{R1} + Vbe.$$

Therefore, even if the NPN transistor base voltage is lower than the bandgap voltage (~1.2V), the disclosed circuit can still create an accurate bandgap voltage by an additional voltage which is created by resistor R4 210. The base of the NPN voltage can be as low as ~0.8V, which provides enough voltage for the source and gate voltage of PMOS2 150 to maintain an "on-state." Therefore, as long as PMOS3 160 operates in its saturation region, this circuit can work, and the supply voltage can be low as ~1.3V.

Equivalent embodiments can utilize bipolar elements in place of the MOSFET elements in the circuit. An additional embodiment can utilize pnp bipolar transistors instead of the p-channel MOSFET devices PMOS1 140, PMOS2 150 and PMOS 3 160. A pnp bipolar transistor current mirror can replace the p-channel MOSFET current mirror formed by PMOS1 140 and PMOS2 150.

Modifications can be made to the disclosed circuit, and operability is maintained when the ratios are maintained as a constant. Resistor pair R2 195 and R3 200 do not have to have equal resistance values as long as the same ratio of resistor R2195 and resistor R 3 200 is established. For example, Resistor R3 200 and resistor R2 195 can be equal to R3=R/n where n is the number of emitter fingers.

The transistor resistances of npn bipolar transistor NPN1 170 and NPN3 220 also do not have to have equal parasitic resistance of the emitter value. This is apparent since the parasitic emitter resistance of the transistors are in series configuration with the resistor pair R2 195 and R 3 200. In this case, the circuit still maintains operability. Note that the base-emitter voltage of npn bipolar transistor NPN1 170 and the base-emitter voltage of npn bipolar transistor NPN2 220 must be the same.

Figure 3:
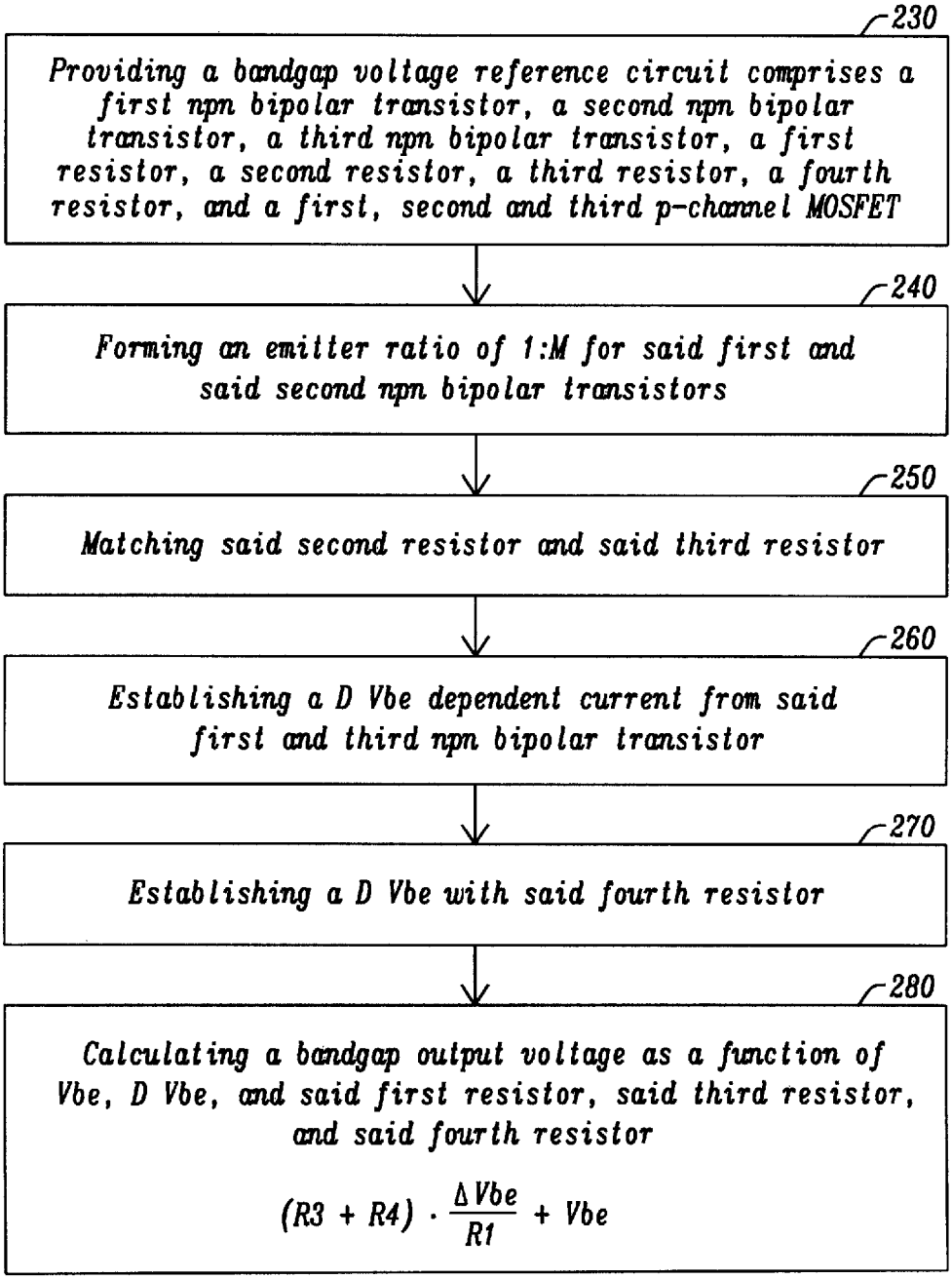

FIG. 3 is a method for providing a modified Brokaw bandgap circuit in accordance with the disclosure. A method of providing a bandgap voltage reference includes a first step providing a first npn bipolar transistor, a second npn bipolar transistor, a third npn bipolar transistor, a first resistor, a second resistor, a third resistor, a fourth resistor, and a first, second and third p-channel MOSFET 230, a second step forming a emitter ratio of 1:M for said first and said second npn bipolar transistors 240, a third step matching said second resistor and said third resistor 250, a fourth step establishing a Δ Vbe dependent current from said first and third npn bipolar transistor 260; a fifth step establishing a Δ Vbe with said fourth resistor 270, and, a sixth step calculating a bandgap output voltage as a function of Vbe, ΔVbe, and said first resistor, said third resistor, and said fourth resistor element 280

$$(R3 + R4) \cdot \frac{\Delta Vbe}{R1} + Vbe.$$

In the embodiment, the npn bipolar transistors can be a homo-junction bipolar transistor or a hetero-junction bipolar transistors. Homo junction bipolar transistors can be silicon, or gallium. Hetero-junction bipolar transistors can be silicon germanium (SiGe), silicon germanium carbon (SiGeC), gallium arsenide (GaAs), or indium phosphide (InP). In addition, the p-channel MOSFET devices can be power transistors, such as LDMOS transistors.

As such, a modified Brokaw bandgap circuit with improvement for low voltage power supplies are are herein described. The improvement is achieved with minimal impact on silicon area or power usage. The improved bandgap reference circuit improves temperature insensitivity and operability at low power supply voltages by the addition of a transistor element, and resistor element.

Other advantages will be recognized by those of ordinary skill in the art. The above detailed description of the disclosure, and the examples described therein, has been presented for the purposes of illustration and description. While the principles of the disclosure have been described above in connection with a specific device, it is to be clearly understood that this description is made only by way of example and not as a limitation on the scope of the disclosure.

What is claimed is:

1. A bandgap voltage reference circuit between a power supply node and a ground node and configured for generating a reference voltage comprising:

a bandgap voltage network;

wherein said bandgap voltage network comprises:

a first npn bipolar transistor; and a second npn bipolar transistor wherein the base of said second npn bipolar transistor and said first npn bipolar transistor are electrically coupled to provide a differential base-emitter voltage;

a feedback network providing feedback to the bandgap voltage network, wherein said feedback network comprises:

a first resistor element electrically connected at one end to the emitter of said second npn bipolar transistor; and second resistor element electrically connected to the emitter of said first npn bipolar transistor, and to the other end of said first resistor;

a current mirror sourcing said bandgap voltage network; and an output network function providing an output voltage, wherein said output network function comprises:

a third npn bipolar transistor wherein the base of said third npn bipolar transistor is electrically connected to the bases of said first and second npn bipolar transistors and to the collector of said third npn bipolar transistor;

a third resistor element electrically connected to the emitter of said third npn bipolar transistor; and a fourth resistor element electrically connected to the collector of said third npn bipolar transistor, and to an output of said bandgap voltage reference circuit.

2. The bandgap voltage reference circuit of claim 1 wherein said current mirror comprises:

a first p-channel MOSFET wherein said p-channel MOSFET gate and drain are electrically connected to said first npn bipolar transistor; and a second p-channel MOSFET wherein said p-channel MOSFET gate is electrically connected to said first p-channel MOSFET and whose p-channel MOSFET drain is electrically connected to said second npn bipolar transistor.

3. The bandgap voltage reference circuit of claim 1 wherein said current mirror comprises two PMOS devices.

4. The bandgap voltage reference circuit of claim 1 wherein said emitter ratio of said first npn bipolar transistor and said second npn bipolar transistor is 1:M wherein M is the multiplicity factor.

5. The bandgap voltage reference circuit of claim 1 wherein said second resistor and third resistor are matched.

6. The bandgap voltage reference circuit of claim 1 wherein said first npn bipolar transistor and said third npn bipolar transistor establishes a ΔVbe dependent current, a PTAT current.

7. The bandgap voltage reference circuit of claim 1 wherein said fourth resistor established a ΔVbe to establish a bandgap voltage of approximately 1.2V.

8. The bandgap voltage reference circuit of claim 7 wherein the base voltage of the first npn bipolar transistor is expressed as a function of Vbe, ΔVbe, and said first and said second resistors $$R2 \cdot \frac{\Delta Vbe}{R1} + Vbe$$

and the bandgap output voltage can be calculated as a function of Vbe, ΔVbe, and said first resistor, said third resistor, and said fourth resistor element $$(R3 + R4) \cdot \frac{\Delta Vbe}{R1} + Vbe.$$

9. A bandgap voltage reference circuit with improved operation at low voltage power supply, the circuit comprising:

a first npn bipolar transistor;

a second npn bipolar transistor wherein the base of said second npn bipolar transistor and first npn bipolar transistor are electrically coupled providing a differential voltage in the base-emitter voltage;

a third npn bipolar transistor wherein the base of said third npn bipolar transistor is electrically connected to the base of said first npn bipolar transistor and electrically connected to the collector of said third npn bipolar transistor;

a first resistor element electrically connected to the emitter of said second npn bipolar transistor;

a second resistor element electrically connected to the emitter of said first npn bipolar transistor;

a third resistor element electrically connected to the emitter of said third npn bipolar transistor;

a fourth resistor element electrically connected to the collector of said third npn bipolar transistor;

a first p-channel MOSFET wherein said p-channel MOSFET gate and drain are electrically connected to said first npn bipolar transistor;

a second p-channel MOSFET wherein said p-channel MOSFET gate is electrically connected to said first p-channel MOSFET and whose p-channel MOSFET drain is electrically connected to said second npn bipolar transistor;

a third p-channel MOSFET wherein said p-channel MOSFET gate is electrically connected to said second p-channel MOSFET and whose p-channel MOSFET drain is electrically connected to said fourth resistor; and, a bandgap voltage reference output wherein said bandgap voltage reference output is connected to said third p-channel MOSFET drain, and said fourth resistor; and, wherein said base voltage of the first npn bipolar transistor is expressed as a function of Vbe, ΔVbe, and said first and said second resistors $$R2 \cdot \frac{\Delta Vbe}{R1} + Vbe$$

and the bandgap output voltage can be calculated as a function of Vbe, ΔVbe, and said first resistor, said third resistor, and said fourth resistor element $$(R3 + R4) \cdot \frac{\Delta Vbe}{R1} + Vbe.$$

10. The bandgap voltage reference circuit of claim 9 wherein said emitter ratio of said first npn bipolar transistor and said second npn bipolar transistor is 1:M wherein M is the multiplicity factor.

11. The bandgap voltage reference circuit of claim 10 wherein said second resistor and third resistor are matched.

12. The bandgap voltage reference circuit of claim 11 wherein said first npn bipolar transistor and said third npn bipolar transistor establishes a ΔVbe dependent current (a PTAT current) wherein the base voltage of the first npn bipolar transistor is expressed as a function of Vbe, ΔVbe, and said first and said second resistors $$R2 \cdot \frac{\Delta Vbe}{R1} + Vbe.$$

13. The bandgap voltage reference circuit of claim 12 wherein said fourth resistor established a ΔVbe to establish a bandgap voltage of approximately 1.2V.

14. The bandgap voltage reference circuit of claim 12 wherein the base voltage of the first npn bipolar transistor is expressed as a function of Vbe, ΔVbe, and said first and said second resistors $$R2 \cdot \frac{\Delta Vbe}{R1} + Vbe$$

and the bandgap output voltage can be calculated as a function of Vbe, ΔVbe, and said first resistor, said third resistor, and said fourth resistor element $$(R3 + R4) \cdot \frac{\Delta Vbe}{R1} + Vbe.$$

15. A bandgap voltage reference circuit with improved operation at low voltage power supply, the circuit comprising:

a first npn bipolar transistor;

a second npn bipolar transistor wherein the base of said second npn bipolar transistor and first npn bipolar transistor are electrically coupled;

a third npn bipolar transistor wherein the base of said third npn bipolar transistor is electrically connected to the base of said first npn bipolar transistor and electrically connected to the collector of said third npn bipolar transistor;

a first resistor element electrically connected to the emitter of said second npn bipolar transistor;

a second resistor element electrically connected to the emitter of said first npn bipolar transistor;

a third resistor element electrically connected to the emitter of said third npn bipolar transistor;

a fourth resistor element electrically connected to the collector of said third npn bipolar transistor;

a first pnp bipolar transistor wherein said first pnp bipolar transistor base and collector are electrically connected to said first npn bipolar transistor;

a second pnp bipolar transistor wherein said second pnp bipolar transistor base is electrically connected to said first pnp bipolar transistor and electrically connected to said second npn bipolar transistor;

a third pnp bipolar transistor wherein said third pnp bipolar transistor base is electrically connected to said second pnp bipolar transistor and electrically connected to said fourth resistor; and, a bandgap voltage reference output wherein said bandgap voltage reference output is connected to said third pnp bipolar transistor, and said fourth resistor; and, wherein said base voltage of the first npn bipolar transistor is expressed as a function of Vbe, ΔVbe, and said first and said second resistors $$R2 \cdot \frac{\Delta Vbe}{R1} + Vbe$$

and the bandgap output voltage can be calculated as a function of Vbe, ΔVbe, and said first resistor, said third resistor, and said fourth resistor element $$(R3 + R4) \cdot \frac{\Delta Vbe}{R1} + Vbe.$$

16. A method of a bandgap voltage reference circuit is comprising providing a bandgap voltage reference circuit comprises a first npn bipolar transistor, a second npn bipolar transistor, a third npn bipolar transistor, a first resistor, a second resistor, a third resistor, a fourth resistor, and a first, second and third p-channel MOSFET;

forming a emitter ratio of 1:M for said first and said second npn bipolar transistors;

matching said second resistor and said third resistor;

establishing a Δ Vbe dependent current from said first and third npn bipolar transistor;

establishing a Δ Vbe with said fourth resistor; and, calculating a bandgap output voltage as a function of Vbe, ΔVbe, and said first resistor, said third resistor, and said fourth resistor $$(R3 + R4) \cdot \frac{\Delta Vbe}{R1} + Vbe.$$

17. The method of claim 16 wherein said first, second and third npn bipolar transistors are homo-junction bipolar transistors.

18. The method of claim 16 wherein said first, second, and third npn bipolar transistors are hetero-junction bipolar transistors.

19. The method of claim 16 wherein said first, second, and third p-channel MOSFET are LDMOS transistors.

20. The method of claim 18 wherein said hetero-junction bipolar transistors are silicon germanium (SiGe).

21. The method of claim 18 wherein said hetero-junction bipolar transistors are silicon germanium carbon (SiGeC).

22. The method of claim 18 wherein said hetero-junction bipolar transistors are gallium arsenide (GaAs).

23. The method of claim 18 wherein said hetero-junction bipolar transistors are indium phosphide (InP).

* * * * *